United States Patent [19]

Hoover et al.

[11] Patent Number: 4,647,107

[45] Date of Patent: Mar. 3, 1987

[54] CONVERTIBLE PATIO TABLE

[75] Inventors: Bobby R. Hoover; Roy G. Fanning, both of Huntsville, Ala.

[73] Assignee: Richard W. Tingle, Huntsville, Ala.

[21] Appl. No.: 668,507

[22] Filed: Nov. 5, 1984

[51] Int. Cl.[4] ..... A47C 13/00

[52] U.S. Cl. ..... 297/124; 108/64

[58] Field of Search ..... 297/125, 124, 159, 157, 297/64

[56] References Cited

U.S. PATENT DOCUMENTS

| | | | |
|---|---|---|---|
| D. 178,611 | 8/1956 | Mickleson | 297/125 X |
| 1,402,542 | 1/1922 | Scanlan | 297/125 |
| 2,481,935 | 9/1949 | Larson | 297/124 X |
| 2,561,703 | 7/1951 | Koenig | 297/124 X |
| 2,836,475 | 5/1958 | Sapp | 108/64 |
| 2,959,209 | 11/1960 | Lakin | 297/124 |
| 3,429,283 | 2/1969 | Uhor | 297/124 X |
| 4,382,627 | 5/1983 | Dean | 297/124 |

*Primary Examiner*—Peter A. Aschenbrenner
*Attorney, Agent, or Firm*—George J. Porter

[57] ABSTRACT

A patio table (10) with attached benches (22) which converts into two completely separate benches (22) with attached backs is disclosed. FIGS. 1 and 2 show the convertible patio table (10) in its assembled configuration. Table top (12) comprises two table top halves (14), having top members (16) attached to top rails (18). FIG. 3 shows the table (10) is transition from its assembled position to its fully disassembled position. FIG. 4 shows the table (10) fully disassembled into two separate benches (22). The backs of benches (22) are formed by unfastening latches (20) and pivoting table top halves (14) and table top support members (24) upward and rearward about bolts (26). Benches (22) comprise top bench members 28, bench rails (30), end bench members (32), foot rails (34) and stops (36). FIG. 5 shows a larger convertible patio table (50) which comprises a convertible patio table (10) assembled together with two table halves (42) of a shorter convertible patio table (40). This larger patio table (50) converts into two long benches (22) and two shorter benches (42), all with attached backs.

4 Claims, 5 Drawing Figures

CONVERTIBLE PATIO TABLE

TECHNICAL FIELD

The present invention relates generally to wooden furniture and more specifically to a patio table with attached benches which can be converted to two separate and matching patio benches with attached backs.

BACKGROUND OF THE INVENTION

Wooden patio tables have been popular for a number of years and are becoming increasingly popular since more and more people are interested in patio cooking and eating picnic-style meals outdoors on their patios or on screened porches. Also, the concept of convertible furniture, particularly tables which convert in some way to chairs or benches, has been known in the past. However, such convertible furniture designed in the past has been heavy, cumbersome, and complicated in design, thus making this convertible furniture expensive to manufacture and impractical from a commercial viewpoint.

One of the first previously-known items of convertible furniture was shown in U.S. Pat. No. 10,908 to BASS. This 1851 patent disclosed a "convertible chair" for the cabin of a ship. This chair was arranged so the back of the chair and the arm of the chair could rotate 90 degrees and the back of the chair would form an attached eating surface in front of the chair seat. This invention was fabricated of heavy metal and provides a design which would be expensive to manufacture today; thus, it would not be satisfactory today as patio furniture.

Another type of convertible furniture is disclosed by U.S. Pat. No. 2,506,852 to BARCUS. This furniture consists of a table with attached benches. It converts to two benches which remain attached and are facing each other. This convertible furniture has a complicated design and, for that reason, would also be expensive to manufacture. Moreover, the benches must remain attached because a lower brace at floor level was apparently considered necessary to strengthen the design. However, this lower brace extends all the way across from one bench to the other and thus constitutes a hazard because a user might trip or stumble over it. The fact that the two benches are permanently attached and are directly facing each other also makes this design inconvenient to use.

A third, known type of convertible furniture is the convertible table shown in U.S. Pat. No. 1,890,129 to ROSS. This patent also discloses a convertible table which converts to two benches. The design of this table is also complicated and requires fabrication of metal, which is heavy and expensive.

Several other examples of convertible furniture are shown in U.S. Pat. Nos. 2,900,009 to HAYNES, 2,645,273 to CULBERTSON et al, 2,557,595 to BUJJONI, and 2,113,346 to HEATH. For various reasons, none of these patents are completely suitable for use as modern patio furniture. The patents to Culbertson and Bujjoni show convertible tables which are flimsy and appear to be shaky. The patents to Haynes and Heath both show convertible items of furniture which are not really suitable for patio use because they have overly complex designs which would be expensive to manufacture. Thus, it may be seen that none of the prior art patents show convertible furniture of modern design which is also simple, strong, and comparatively inexpensive to manufacture.

Therefore, the object of this invention is to provide a convertible table which is simple and modern in design, strong, and comparatively inexpensive to manufacture.

A further object of this invention is to provide a convertible table which is attractive and has a design which allows it to be constructed of wood.

SUMMARY OF THE INVENTION

The present invention is a convertible patio table with attached benches. It is capable of being separated into two halves, each half being capable of converting into a bench with an attached back. The invention comprises: two table top halves; latch means for fastening said table top halves together; two benches, each said bench being positioned behind one of said table top halves; means for supporting said table top halves and for attaching each said table top half to its corresponding said bench; and means for pivoting both said table top halves upward and backward to rear positions behind said benches; whereby said table top halves may be unlatched and each of said table top halves may be pivoted to its respective said rear position, thus providing two separate benches with backs.

DETAILED DESCRIPTION OF THE INVENTION

Figure 1:
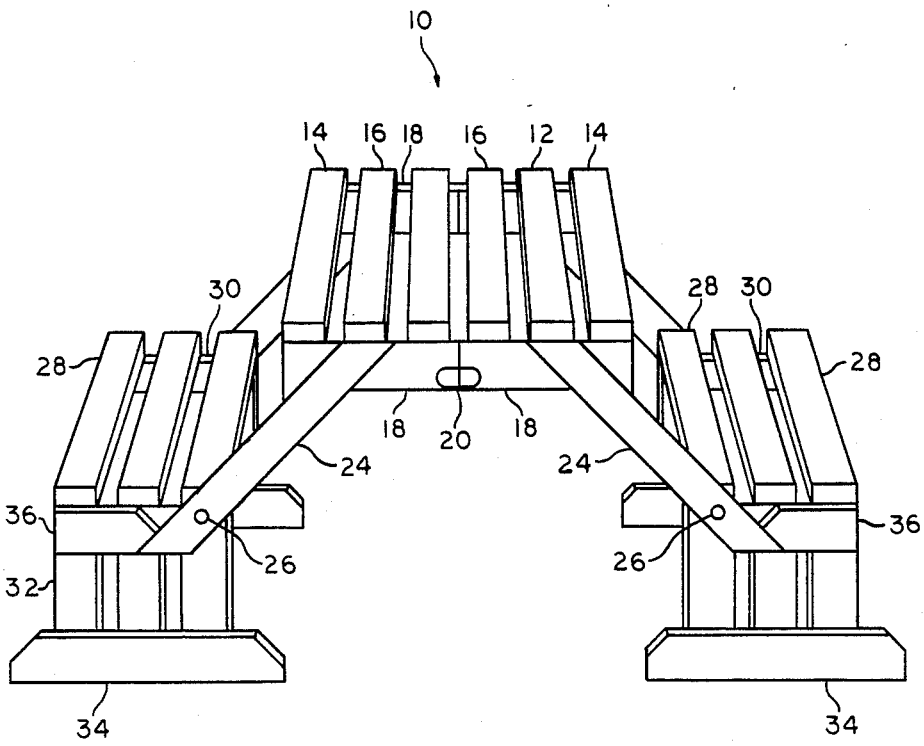
FIG. 1 is a perspective view of the convertible patio table as viewed looking toward one of its ends.

FIG. 1 is a perspective view showing the convertible patio table in its assembled configuration and ready for use. The table is shown generally by the numeral 10. Table top 12 is comprised of two table top havles 14, each half 14 comprising a plurality of top members 16 and a plurality of top rails 18. Top members 16 run perpendicular to and are securely attached to the top rails 18. In the preferred embodiment, each table top half 14 comprises three top members 16 attached to two top rails 18. Patio table 10 is preferably long enough to accommodate 6 persons, 3 persons on each side.

In the preferred embodiment of the invention, all the structural members of the invention are redwood 2"×4" lumber, although these structural members could obviously be of different sizes and of different materials. When constructed of wood which resists rotting, such as redwood, cypress, cedar or teak, this table is less expensive to build than metal tables and will stand up better under all-weather conditions.

Figure 2:
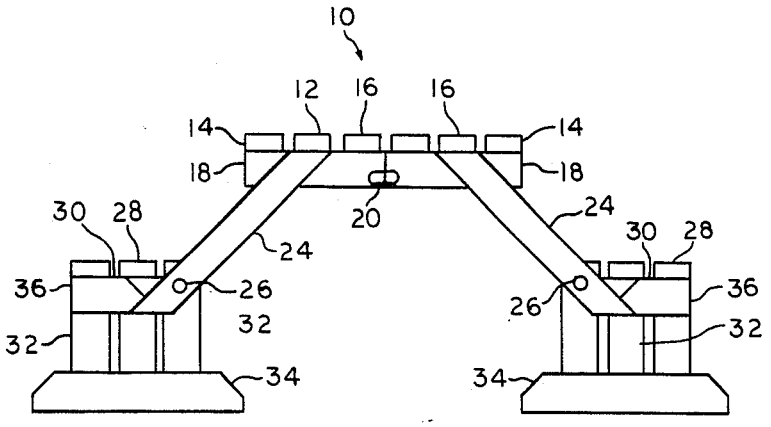
FIG. 2 is an end view of the invention as shown in FIG. 1.

As shown in the end view of FIG. 2, and also in FIG. 1, two table top halves 14 are latched together at each of their ends by latches 20 attached to top rails 18. To latch table top halves 14 together in this manner, the corresponding ends of top rails 18 on the underside of the two table top halves 14 are butted together end-to-end. Latches 20, which have male portions on one top rail 18 and female portions on the second (abutting) top rail 18, are then fastened together to hold patio table 10 in the assembled position.

Table 10 comprises two benches 22. Each bench 22 is attached to one table top half 14 by two table top support members 24. Each support member 24 has one end fixedly attached to one top rail 18 and its other end pivotally attached to the side of the bench 22 by bolts 26. Each bench 22 is made up of a plurality of top bench members 28 attached at each of their ends to a bench rail 30. A plurality of end bench members 32 are also attached at their upper ends to the bench rails 30. The lower ends of the end bench members 32 are attached to foot rails 34, which rest on the ground or on the patio. Attached to each side of each bench 22 is a stop 36 which abuts the side of one support member 24 when the patio table 10 is in the assembled position. Each stop 36 is positioned and configured so that it abuts the side of the table top support 24 so as to hold the support 24 at the proper angle so that its attached table top half 14 remains level.

Figure 3:
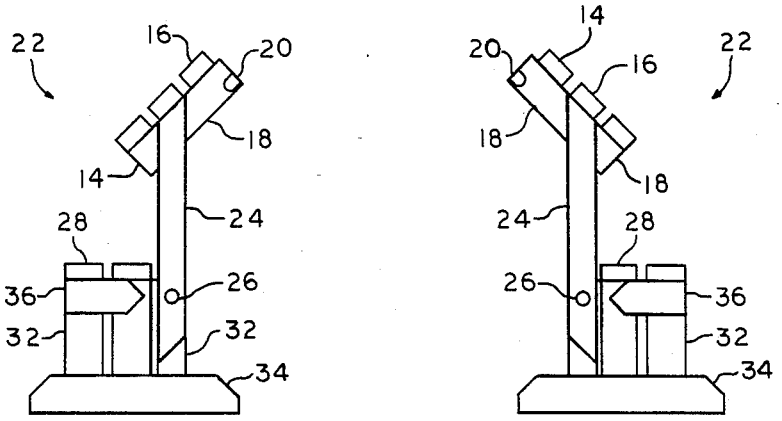
FIG. 3 is an end view of the invention as shown in FIG. 2 but with the two halves of the table top disengaged and tilted upward.

Looking now at the end view of the invention shown in FIG. 3, the convertible feature of this invention may be seen. In this view, latches 20 at both ends of patio table 10 have been disengaged and both table top halves 14 have been pivoted upward and backward around pivot points represented by bolts 26 located at each end of each bench 22.

Figure 4:
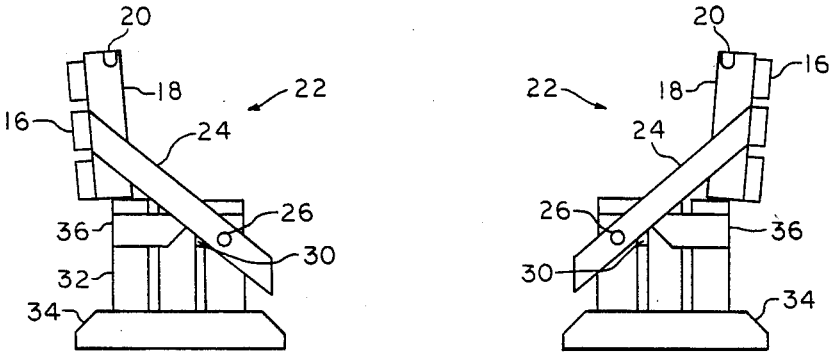
FIG. 4 is an end view of the invention as shown in FIG. 3 but with the two halves of the table top tilted backward to their rear limits to form backs for the two benches.

In FIG. 4, table top halves 14 have been pivoted upward and backward to their rearmost position. This position is reached when the ends of the top rails 18 abut the rearmost one of the top bench members 28. In this disassembled position, as shown in FIG. 4, patio table 10 takes the form of two separate benches 22 with backs. The top of each table top half 14 has now become the outside of the attached back of the corresponding bench 22. The bottom of each table top half 14 has now become the inside of the attached back of the corresponding bench 22.

By giving attention to the end views of the invention shown in FIGS. 2–4, certain design details may be seen:

1. Table top support members 24 are attached to top rails 18 with the long axis of members 24 at a 45 degree angle with the long axis of top rails 18. This allows ease of construction and holds table top halves 14 level when the table is in the assembled configuration.

2. Each stop 36 is mitered with two 45 degree cuts providing a point on its front end. Each stop 36 is mounted with its top edge even with the top of end bench members 32 and with the edge of the lower 45 degree cut abutting the edge of the adjacent table top support member 24. This allows stop 36 to hold top rail support members 24 at the proper angle to hold table top halves 14 level. Stops 36 are also positioned and configured so that the back ends of stops 36 line up flush with the back side of benches 22.

3. Foot rails 34 are each mitered at 45 degrees on the top corners of each of their ends. This eliminates the presence of sharp corners which might injure the feet or ankles of persons using the table 10 or benches 22. Also, in the preferred embodiment of the invention, foot rails 34 are designed to stick out several inches beyond the front of benches 22 and the same distance beyond the back of benches 22 in order to provide exceptional stability to both the table 10 and benches 22.

Figure 5:
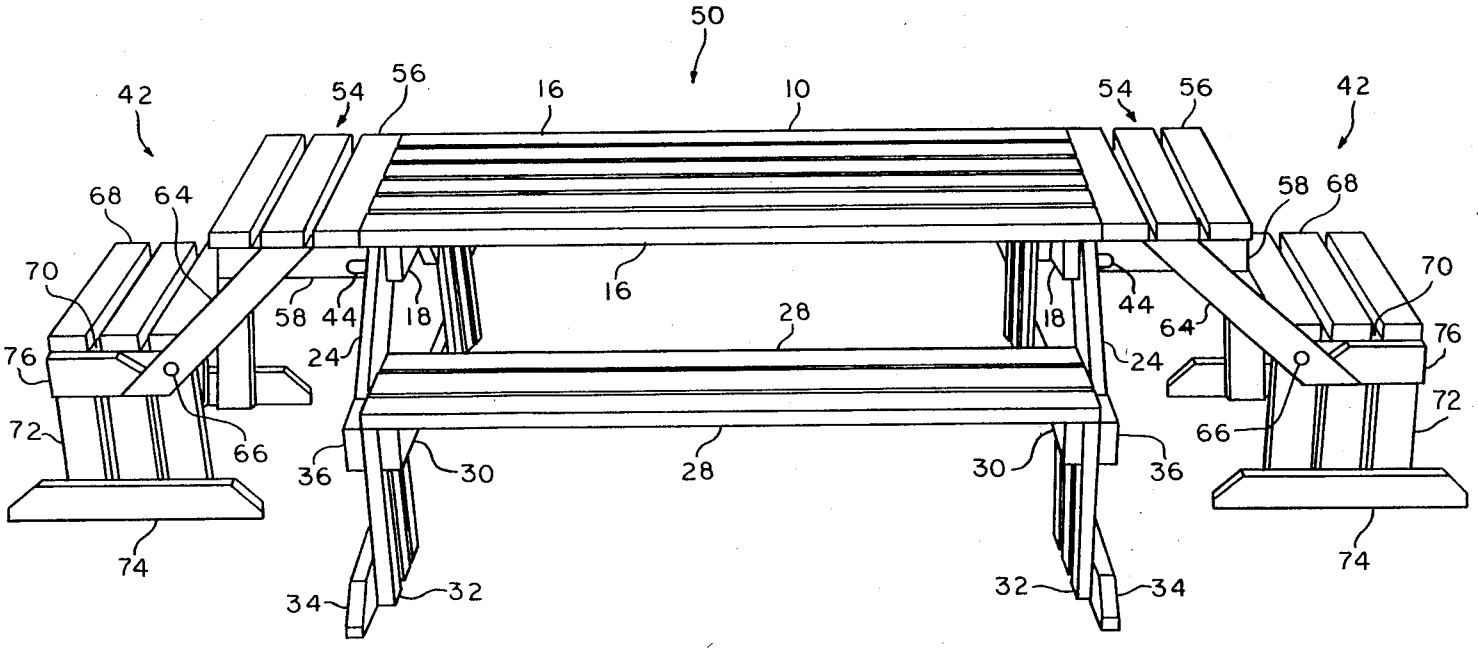
FIG. 5 is a perspective view of an alternative embodiment of the invention, which is larger and can seat more persons than the invention shown in FIGS. 1 and 2.

FIG. 5 is a perspective view of an alternative embodiment of the invention shown in FIGS. 1 and 2. This embodiment is an enlarged version of the invention capable of providing additional table top area and additional seating for at least two persons. This larger-sized patio table 50 is achieved by combining one patio table 10 (as shown in FIGS. 1 and 2) with a shorter version 40 of patio table 10. As may be seen in FIG. 5, the patio table 10 forms the center of the new larger sized patio table 50. Then, one half 42 of the shorter version patio table 40 is attached to each end of the center patio table 10. Halves 42 of patio table 40 are designed so that their length is equal to the width of table top 12 of the center patio table 10. As is clearly shown in FIG. 5, table halves 42 of patio table 40 are turned with their long axis perpendicular to the long axis of the center patio table 10. Thus, when halves 42 are attached to patio table 10, a new larger patio table 50 is formed, with the same width as patio table 10 but with the effective length (and table top space) of table 10 increased.

Patio table 40 comprised of two patio table halves 42 is constructed in a manner similar to the construction of patio table 10 already described. However, as mentioned above, patio table 40 is shorter than patio table 10 and has a length equal to the width of patio table 10. Table halves 42 each have a table top half 54, which is supported above benches (chairs) 42 by a table top support member 64. Table top halves 54 comprise top members 56 which are attached to top rails 58. Each support member 64 has one end fixedly attached to one top rail 58 and its other end pivotally attached to the side of the bench 42 by bolts 66. Each bench 42 is made up of a plurality of top bench members 68 attached at each of their ends to a bench rail 70. A plurality of end bench members 72 are also attached at their upper ends to the bench rails 70. The lower ends of the end bench member 72 are attached to foot rails 74, which rest on the ground or on the patio. Attached to each side of each bench 42 is a stop 76 which abuts the side of one support member 64 when the patio table 40 is in the mode of table half 42. Each stop 76 is positioned and configured in a manner similar to stops 36 already described so that it abuts the side of the table top support 64 at the proper angle to hold attached table top half 54 level.

To assemble patio table 50, the long axis of table halves 42 are turned perpendicular to the long axis of patio table 10 and attached to the ends of patio table 10 with latches 44, which are similar to latches 20 described earlier. Thus, in the preferred embodiment of patio table 50, a seat and table top space sufficient for one person is added at each end of the patio table 10. Therefore, the preferred embodiment of patio table 50 seats eight persons whereas the preferred embodiment of patio table 10 seats six persons. When patio table 50 is disassembled, it converts to two long benches 22 with backs (as already described for patio table 10). Also, each table half 42 converts into two additional short benches (or chairs) 42 with backs, each capable of seating one person. This conversion is accomplished in a manner similar to the way each half of patio table 10 converts into a bench 22. Although table halves 42 are not shown connected to a bench or chair 42, these benches 42 are obviously like the benches 22 shown in FIGS. 1–4 except that they are shorter in length.

From the above, it may be seen that the invention provides a convertible patio table which is an improvement over previous items of convertible furniture. This table is simple and strong, yet modern and attractive, and is designed so that it may be constructed inexpensively of wood. Moreover, the table may be converted into two completely separate benches with attached backs. An alternative embodiment of the invention shown in FIG. 5 provides a larger convertible patio table comprising a preferred embodiment of the patio table of FIGS. 1–4 extended in length by attachment of one half of a shorter patio table at either end of the preferred embodiment. This larger patio table may be disassembled and converted to two long benches and two short benches or chairs, all completely separate.

We claim:

1. An enlarged convertible patio table comprising:

two large rectangular table top halves arranged to be butted together with their long sides touching;

first latch means for fastening said large table top halves together;

two benches, each said bench being positioned behind one of said table top halves;

means for supporting said large table top halves and for attaching each said large table top half to its corresponding said bench; and means for pivoting both said large table top halves upward and backward to rear positions behind said benches, whereby said large table top halves may be unlatched and each of said large table top halves may be pivoted to its respective said rear position, thus providing two separate benches with backs;

two small table top halves, said smaller table top halves having a length equal to the total width of said two large table top halves when said two large table top halves are joined together;

second latch means for fastening each of said small table top halves to the ends of said patio table;

two small benches, each said small bench being positioned behind one of said small table top halves;

means for supporting said small table top halves and for attaching each said small table top half to its corresponding said small bench; and means for pivoting both said small table top halves upward and backward to rear positions behind said small benches;

whereby said two large table top halves may be latched together to form a patio table and said two small table top halves may be latched to the ends of said patio table to form an enlarged patio table which has the same width as said patio table but is longer than said patio table and whereby said two large table top halves and said two small table top halves may all be unlatched and each of said four table top halves may be pivoted to its respective said rear position, thus providing four separate benches with backs.

2. The enlarged convertible patio table of claim 1 wherein said second latch means comprises two, two-piece latches positioned on opposite sides of each said small table top half for attaching each said small table top half to one of the ends of said two large table top halves.

3. The enlarged convertible patio table of claim 2 wherein each said two-piece latch comprises a first piece mounted on one side of each said small table top and a second piece mounted on one of said support means at the end of one of said two large table halves in a position so as to mate with said first piece.

4. The enlarged convertible patio table of claim 3 wherein said enlarged table is designed and configured so that it may be fabricated of lumber comprising only pieces of standard 2×4 lumber.

* * * * *